US010811791B2

(12) United States Patent
Love

(10) Patent No.: US 10,811,791 B2
(45) Date of Patent: Oct. 20, 2020

(54) GROUNDING CROSS CONNECTORS INCLUDING CLAMPING PADS FOR COUPLING AT LEAST TWO CONDUCTORS

(71) Applicant: Panduit Corp., Tinley Park, IL (US)

(72) Inventor: Julie M. Love, Tinley Park, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 16/266,858

(22) Filed: Feb. 4, 2019

(65) Prior Publication Data

US 2019/0245282 A1 Aug. 8, 2019

Related U.S. Application Data

(60) Provisional application No. 62/626,330, filed on Feb. 5, 2018.

(51) Int. Cl.

| | |
|---|---|
| ***H01R 4/50*** | (2006.01) |
| ***H01R 11/15*** | (2006.01) |
| ***H01R 4/40*** | (2006.01) |
| ***H01R 4/64*** | (2006.01) |
| ***H01R 4/46*** | (2006.01) |

(52) U.S. Cl.

CPC ..... *H01R 4/5091* (2013.01); *H01R 4/40* (2013.01); *H01R 4/46* (2013.01); *H01R 4/64* (2013.01); *H01R 4/646* (2013.01); *H01R 11/15* (2013.01)

(58) Field of Classification Search

CPC ..... H01R 4/5091; H01R 4/40; H01R 4/46; H01R 4/64; H01R 4/646; H01R 11/15; H01R 24/30; H01R 12/596; H01R 4/60; H01R 4/643

USPC ..... 439/807, 98–101, 804

See application file for complete search history.

(56) References Cited

U.S. PATENT DOCUMENTS

| | | | |
|---|---|---|---|
| 2,679,032 | A | 5/1954 | Thomas, Jr. et al. |
| 3,892,455 | A | 7/1975 | Sotolongo |
| 4,114,977 | A | 9/1978 | Polidori |
| 4,457,577 | A | 7/1984 | Browne et al. |
| 4,911,572 | A | 3/1990 | Williams |
| 4,976,627 | A | 12/1990 | O'Laughlin |
| 5,320,565 | A | 6/1994 | Polidori |
| 6,494,726 | B1 | 12/2002 | Auclair |
| 6,976,857 | B1 | 12/2005 | Shukla et al. |
| 7,160,142 | B2 | 1/2007 | Hughes et al. |
| 7,492,996 | B2 | 2/2009 | Kowalczyk et al. |

(Continued)

OTHER PUBLICATIONS

Eritech's Signal Reference Grid Connector catalog literature, https://www.erico.com/catalog/literature/E458S-NAEN.pdf, 1 page.

*Primary Examiner* — Travis S Chambers

(74) *Attorney, Agent, or Firm* — Christopher S. Clancy; James H. Williams; Peter S. Lee

(57) ABSTRACT

Various implementations of grounding cross connectors are disclosed. The grounding cross connectors may be used to clamp together two or more, often perpendicular, conductors. In some implementations, a grounding cross connector includes an upper clamping pad and a lower clamping pad held together by a pair of threaded fasteners. A pair of perpendicular conductors may be placed in between the clamping pads and secured together by torquing nuts on the threaded fasteners. The upper clamping pad may include a hook through which one of the threaded fasteners may pass, thereby allowing the upper clamping to rotate relative to the lower clamping pad.

9 Claims, 12 Drawing Sheets

(56) References Cited

U.S. PATENT DOCUMENTS

| | | | | |
|---|---|---|---|---|
| 7,621,763 | B2 | 11/2009 | Clark et al. | |
| 7,794,243 | B1 | 9/2010 | Rzasa et al. | |
| 8,007,293 | B2 | 8/2011 | Boutin | |
| 8,021,169 | B1 | 9/2011 | Smith | |
| 8,038,453 | B2 | 10/2011 | Robicheau et al. | |
| 8,177,563 | B1 | 5/2012 | Vernica | |
| 8,192,210 | B2 | 6/2012 | Gardner et al. | |
| 8,313,334 | B2 | 11/2012 | Ruland | |
| 8,317,526 | B2 | 11/2012 | Gardner et al. | |
| 8,341,822 | B2 | 1/2013 | Rzasa et al. | |
| 8,449,308 | B2 | 5/2013 | Smith | |
| 8,864,502 | B2 * | 10/2014 | Dinh | H01R 24/30 439/97 |
| 8,864,504 | B1 | 10/2014 | Gretz | |
| 9,787,004 | B2 * | 10/2017 | Dinh | H01R 4/26 |
| 10,109,932 | B2 * | 10/2018 | Trombley | H01R 4/46 |
| 2008/0153328 | A1 * | 6/2008 | Ho | H01R 4/2407 439/98 |
| 2010/0144173 | A1 * | 6/2010 | Wason | H01R 4/38 439/100 |
| 2014/0345938 | A1 * | 11/2014 | Royer | H01R 4/46 174/88 R |
| 2018/0040966 | A1 | 2/2018 | Diop et al. | |
| 2019/0165500 | A1 * | 5/2019 | Diop | H01R 11/15 |

* cited by examiner

GROUNDING CROSS CONNECTORS INCLUDING CLAMPING PADS FOR COUPLING AT LEAST TWO CONDUCTORS

CROSS REFERENCE TO RELATED APPLICATIONS

This application claims priority to U.S. Provisional Application No. 62/626,330, filed Feb. 5, 2018, the subject matter of which is hereby incorporated by reference in its entirety.

BACKGROUND

Grounding connectors may be used to clamp together two or more conductors to establish an electrical pathway. The conductors may be arranged in a grid configuration with two conductors intersecting at a perpendicular angle. Current grounding conductors require removal of the fastener of the grounding conductor in order to place the perpendicular conductors between the grounding connector. The fastener must then be inserted into the grounding connector and tightened to clamp the perpendicular conductors to establish an electrical pathway.

SUMMARY

The present invention provides a grounding cross connector including an upper clamping pad having perpendicular grooves configured to hold a set of grounding conductors, a lower clamping pad having perpendicular grooves configured to hold the set of grounding conductors, and first and second threaded fasteners configured to compress the upper clamping pad and the lower clamping pad against the set of grounding conductors. The present invention further provides for a grounding cross connector that includes the upper clamping pad being configured to pivot about the second threaded fastener to engage the first fastener.

In accordance with another aspect of the invention, a grounding cross connector includes a main clamping pad having perpendicular grooves to hold a set of grounding conductors and first and second threaded posts, a left clamping pad to clamp one of the set of grounding connectors between the left clamping pad and the main clamping pad, and a right clamping pad to clamp another of the set of grounding connectors between the right clamping pad and the main clamping pad.

In accordance with another aspect of the invention, a method is provided comprising inserting a first grounding conductor of a set of grounding conductors in one of a pair of perpendicular grooves in a lower clamping pad, inserting a second grounding conductor in one of a pair of perpendicular grooves in an upper clamping pad, and tightening first and second threaded fasteners to compress the upper clamping pad and the lower clamping pad against the set of grounding conductors.

BRIEF DESCRIPTION OF THE DRAWINGS

Objects, features, and advantages of the present invention will become apparent upon reading the following description in conjunction with the drawing figures in which.

DETAILED DESCRIPTION

Figure 1:
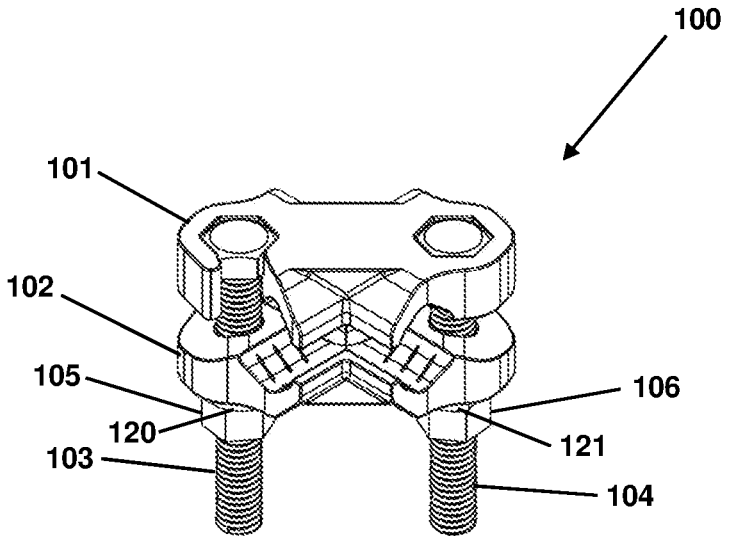
FIG. 1 is an illustration of an example grounding cross connector.
Figure 2:
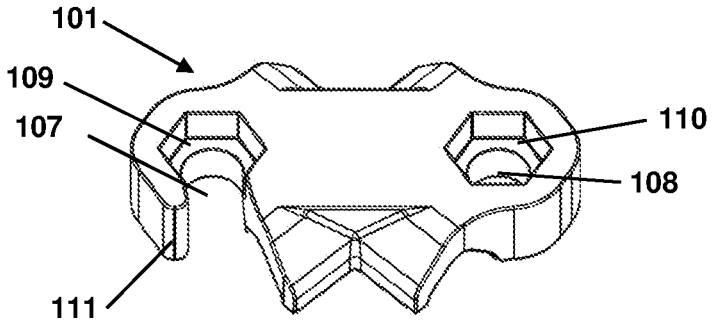
FIGS. 2-4 are illustrations of a portion of the example grounding cross connector shown in FIG. 1.
Figure 3:
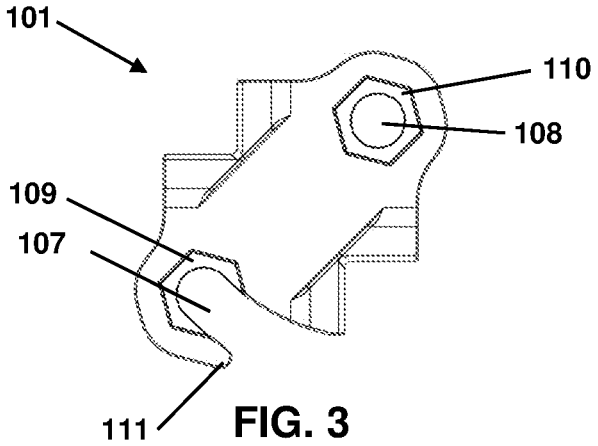
Figure 4:
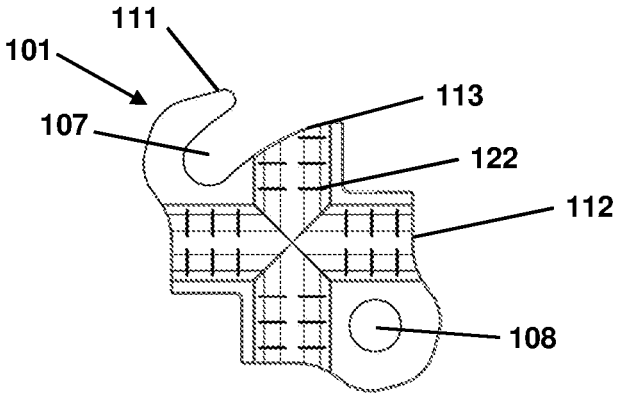
Figure 5:
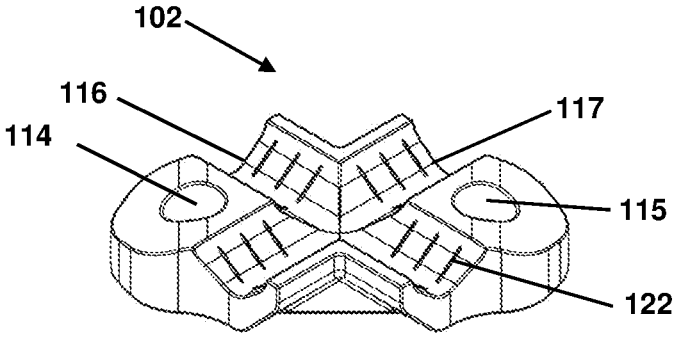
FIGS. 5-7 are illustrations of another portion of the example grounding cross connector shown in FIG. 1.
Figure 6:
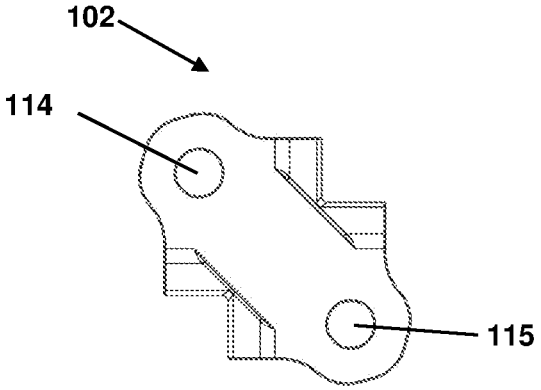
Figure 7:
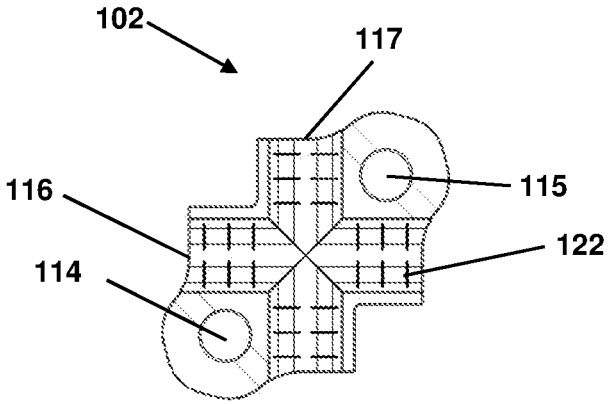

The disclosed grounding cross connector is configured such that the upper clamping pad pivots open and closed about one of the fasteners. This pivoting action enables the grounding cross connector to be installed without having to remove any of the components of grounding cross connector. The result is a faster and more efficient instillation.

Reference will now be made to the accompanying drawings. Wherever possible, the same reference numbers are used in the drawings and the following description to refer to the same or similar parts. It is to be expressly understood, however, that the drawings are for illustration and description purposes only. While several examples are described in this document, modifications, adaptations, and other implementations are possible. Accordingly, the following detailed description does not limit the disclosed examples. Instead, the proper scope of the disclosed examples may be defined by the appended claims.

FIGS. 1-10 are illustrations of an example grounding cross connector 100. In some implementations, grounding cross connector 100 may be used to clamp together two or more perpendicular or substantially perpendicular conductors, such as copper conductors 118 and 119 illustrated in FIG. 10.

Grounding cross connector 100 may include an upper clamping pad 101, a lower clamping pad 102, a pair of fasteners 103 and 104 (which can be a screw, bolt, or other types of threaded fasteners), nuts 105 and 106, and washers 120 and 121. The various components included in grounding cross connector 100 may be made of various conducting materials, such as various types of metals.

To assemble grounding cross connector 100, fastener 104 may be inserted through opening 108 in upper clamping pad 101 and opening 115 in lower clamping pad 102 until the head of fastener 104 sits in recess 110. Similarly, fastener 103 may be inserted through opening 107 in upper clamping pad 101 and opening 114 in lower clamping pad 102 until the head of fastener 103 sits in recess 109. Washers 120 and 121 may be respectively slid onto fasteners 103 and 104. Nuts 105 and 106 may be respectively threaded onto the threaded shafts of fasteners 103 and 104.

The design of grounding cross connector 100 allows upper clamping pad 101 to swing or pivot open and closed. This pivoting action allows the end user to install grounding cross connector 100 without having to remove any of the components of grounding cross connector 100, and therefore allows for quicker installation.

Figure 8:
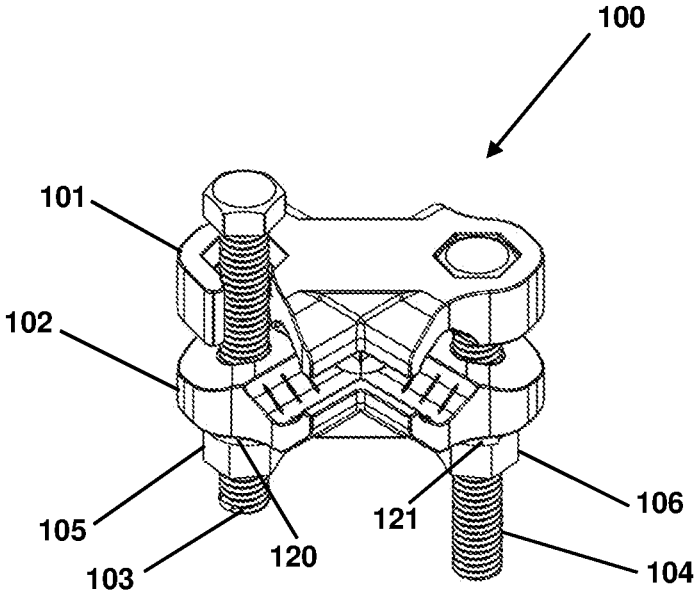
FIG. 8 is another illustration of the grounding cross connector shown in FIG. 1.
Figure 9:
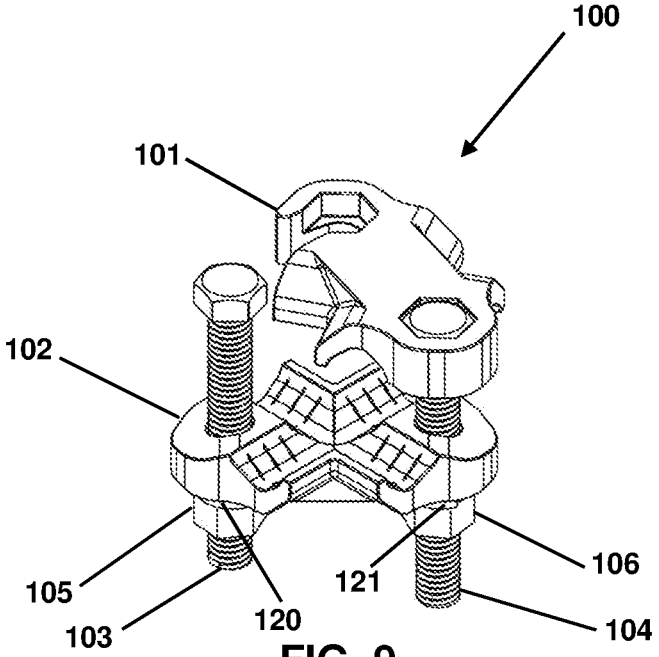
FIG. 9 is another illustration of the grounding cross connector shown in FIG. 1.

To install grounding cross connector 100 on perpendicular conductors 118 and 119, the installer may loosen nut 105 on fastener 103 and nut 106 on fastener 104 so that there is enough room between upper clamping pad 101 and lower clamping pad 102 to insert conductors 118 and 119. The installer may swing open upper clamping pad 101 relative to lower clamping pad 102 (as shown in FIG. 9) by removing the head of fastener 103 from recess 109 (as shown in FIG. 8) so that the shaft of fastener 103 may fit through hook 111.

Figure 10:
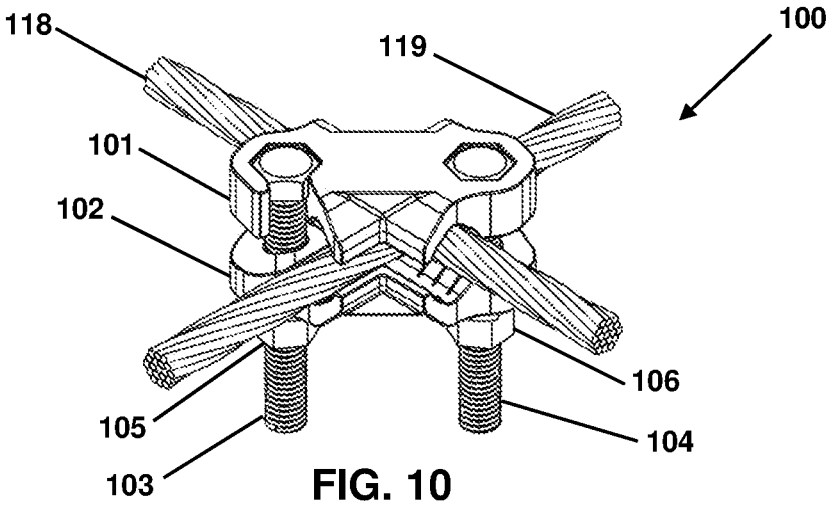
FIG. 10 is another illustration of the grounding cross connector shown in FIG. 1 with conductors installed therein.
Figure 11:
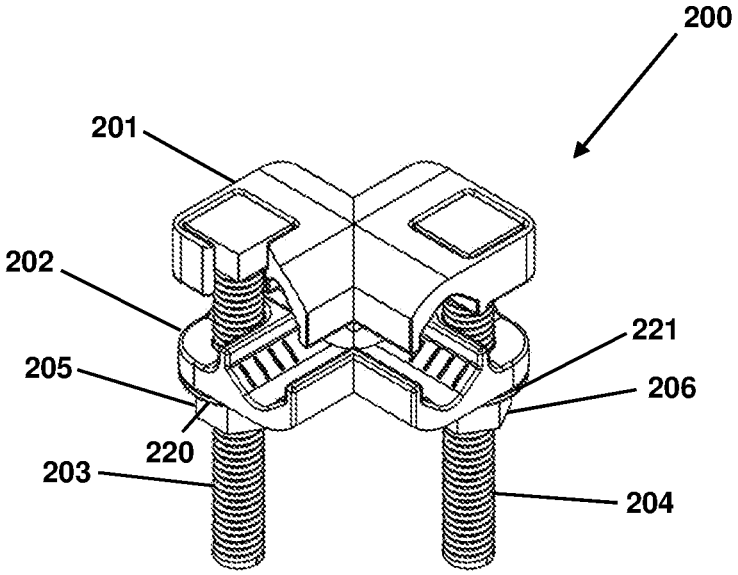
FIG. 11 is an illustration of another example grounding cross connector.
Figure 12:
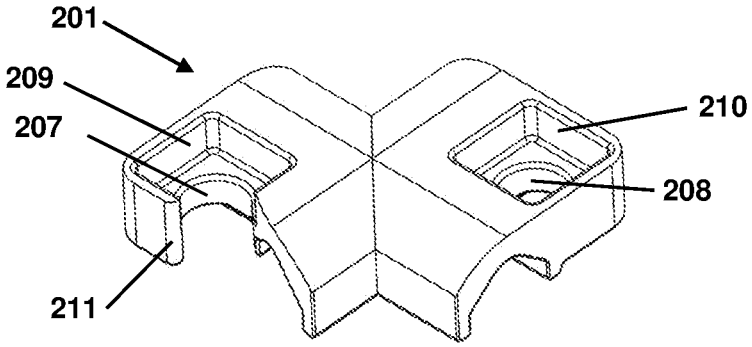
FIGS. 12-14 are illustrations of a portion of the example grounding cross connector shown in FIG. 11.
Figure 13:
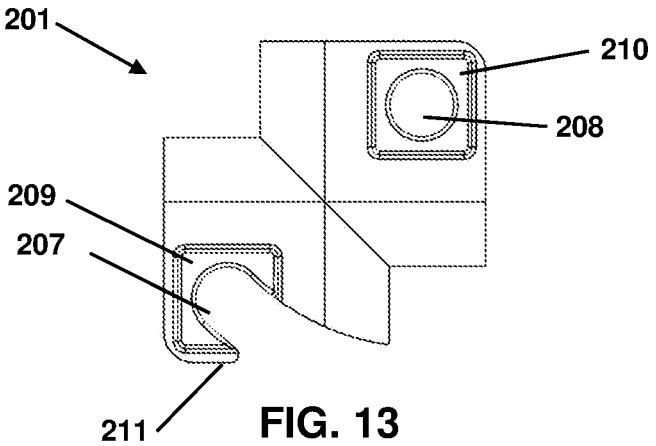
Figure 14:
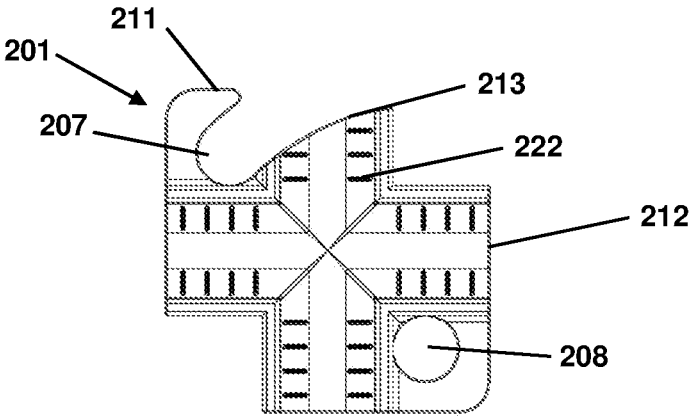
Figure 15:
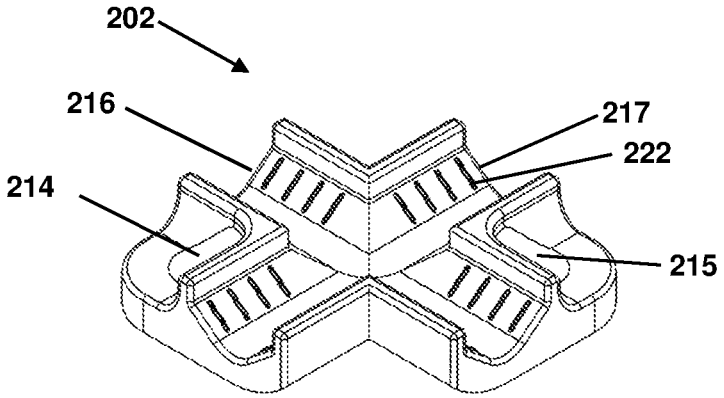
FIGS. 15 and 16 are illustrations of another portion of the example grounding cross connector shown in FIG. 11.
Figure 16:
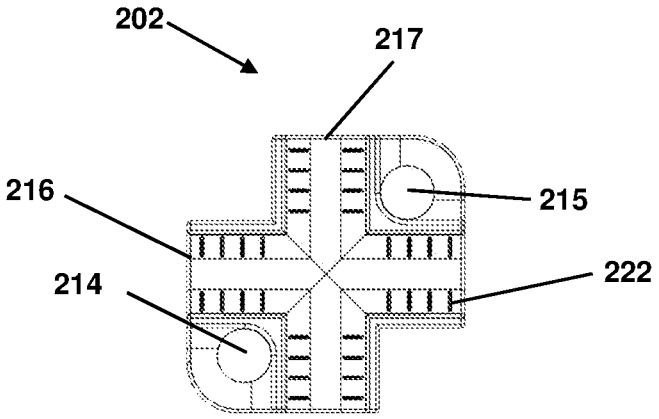
Figure 17:
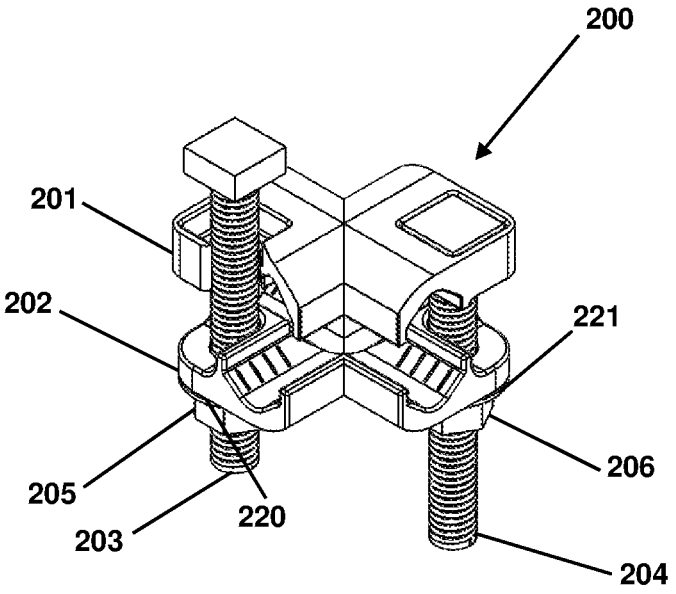
FIG. 17 is another illustration of the grounding cross connector shown in FIG. 11.
Figure 18:
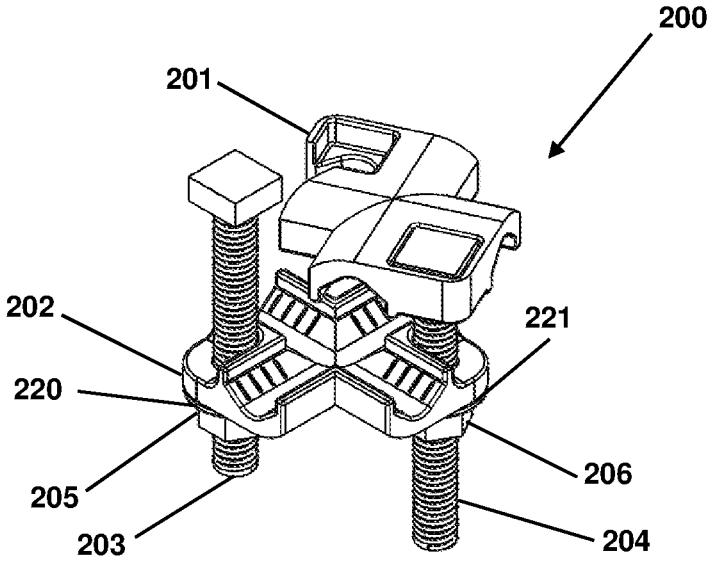
FIG. 18 is another illustration of the grounding cross connector shown in FIG. 11.
Figure 19:
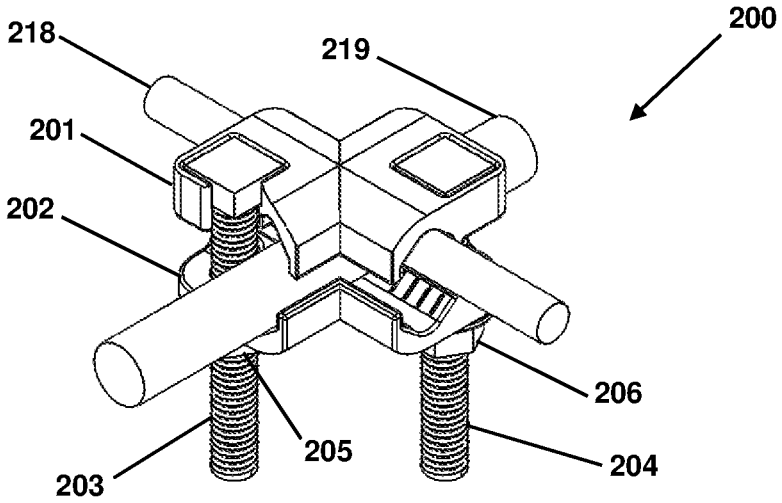
FIG. 19 is another illustration of the grounding cross connector shown in FIG. 11 with conductors installed therein.
Figure 20:
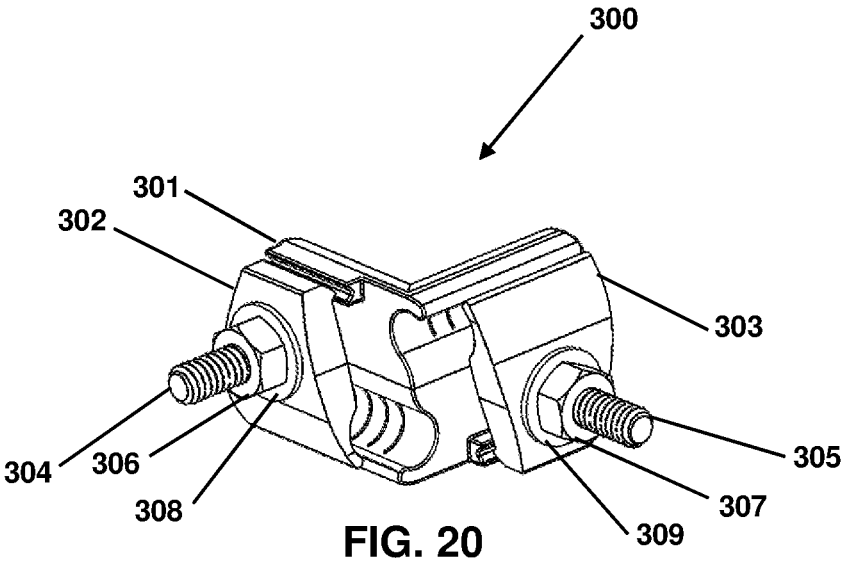
FIG. 20 is an illustration of another example grounding cross connector.
Figure 21:
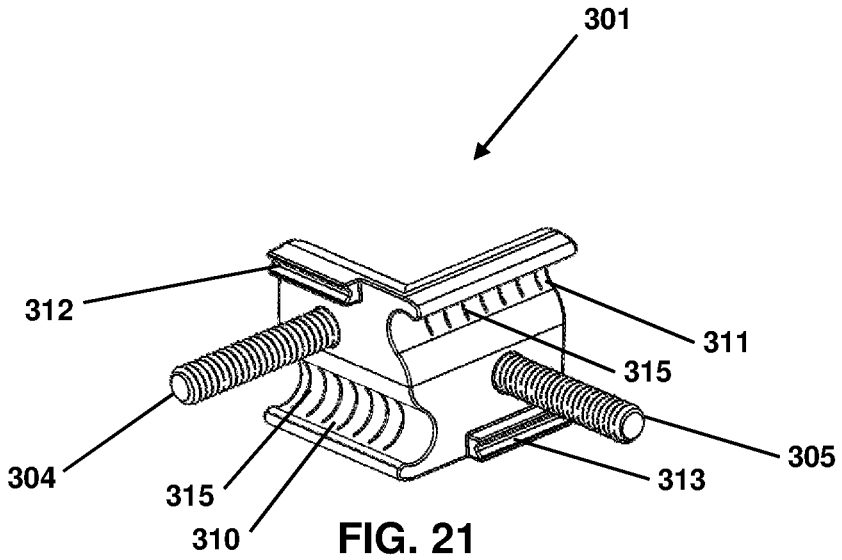
FIG. 21 is an illustration of a portion of the example grounding cross connector shown in FIG. 20.

Upper clamping pad 101 and lower clamping pad 102 each have a set of perpendicular grooves (i.e., grooves 112 and 113 for upper clamping pad 101 and grooves 116 and 117 for lower clamping pad 102), which allow conductors 118 and 119 to be positioned in either direction. For example, conductor 118 may be placed in groove 112 of upper clamping pad 101 while conductor 119 is placed in groove 117 of lower clamping pad 102, as shown in FIG. 10. Alternatively, conductor 118 may be placed in groove 113 of upper clamping pad 101 while conductor 119 is placed in groove 116 of lower clamping pad 102. Grooves 112, 113, 116, and 117 may be sized to accommodate a wide range of conductor sizes to ensure the conductors are securely held in place by grounding cross connector 100. Grooves 112, 113, 116, and 117 may also have a set of serrations (or raised portions) 122 on their respective surfaces to improve holding power of conductors 118 and 119.

With the bottom conductor (which is shown in the example in FIG. 10 to be conductor 119) placed in one of the grooves in lower clamping pad 102, the installer may swing upper clamping pad 101 closed so that the shaft of fastener 103 is placed through hook 111, and the head of fastener 103 is inserted into recess 109. The installer ensures that the top conductor (which is shown in the example in FIG. 10 to be conductor 118) is placed in one of the grooves in upper clamping pad 101 before tightening the cross connector 100.

When the conductors are in place, the installer evenly torques nuts 105 and 106. The shape of recesses 109 and 110 are designed to match the shapes of the heads of fasteners 103 and 104. As an example, FIGS. 1-10 show grounding cross connector 100 having recesses 109, 110 and heads of fasteners 103, 104 having hex shapes, whereas FIGS. 11-19 illustrate an example grounding cross connector 200 having fasteners 203 and 204 with square-shaped heads and corresponding square-shaped recesses 209 and 210. The matching shapes of recesses and fastener heads allow the heads to become trapped when tightened. This allows the nuts to be tightened without the need to use another tool to hold onto the fastener heads, and prevents the fasteners from rotating which would cause grounding cross clamp to open inadvertently.

When the heads of fasteners 103 and 104 become trapped, the top of the heads will be flush with the top surface of upper clamping pad 101. This allows the installer to easily check if the fastener heads are appropriately resting in recesses 109 and 110.

FIGS. 20-23 are illustrations of an example grounding cross connector 300. In some implementations, grounding cross connector 300 may be used to clamp together two or more perpendicular or substantially perpendicular conductors, such as copper conductors 320 and 321 illustrated in FIG. 23.

Figure 22:
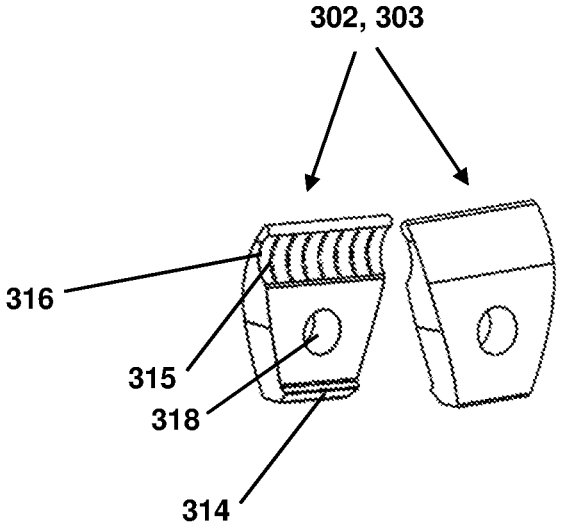
FIG. 22 is an illustration of other portions of the example grounding cross connector shown in FIG. 20.

Grounding cross connector 300 may include a main clamping pad 301, a left clamping pad 302 and a right clamping pad 303, washers 308 and 309, and nuts 306 and 307. As shown in FIG. 22, left and right clamping pads 302 and 303 may be identical to each other. The components included in grounding cross connector 300 may be made of various conducting materials, such as various types of metals.

To assemble grounding cross connector 300, threaded rods 304 and 305 may be respectively inserted through opening 318 in left clamping pad 302 and opening 318 in right clamping pad 303. Washers 308 and 309 may then be respectively placed on threaded rods 304 and 305, and then nuts 306 and 307 may follow.

The design of grounding cross connector 300 allows the end user to install conductors 320 and 321 without having to remove any of the components of grounding cross connector 300, and therefore allows for quicker installation. To install grounding cross connector 300 on perpendicular conductors 320 and 321, the installer may loosen nuts 306 and 307 so that there is enough room between main clamping pad 301 and left and right clamping pads 302 and 303 to insert conductors 320 and 321. The installer may insert conductor 320 between left clamping pad 302 and main clamping pad 301 from below grounding cross connector 300 and may insert conductor 320 between left clamping pad 302 and main clamping pad 301 from below.

Figure 23:
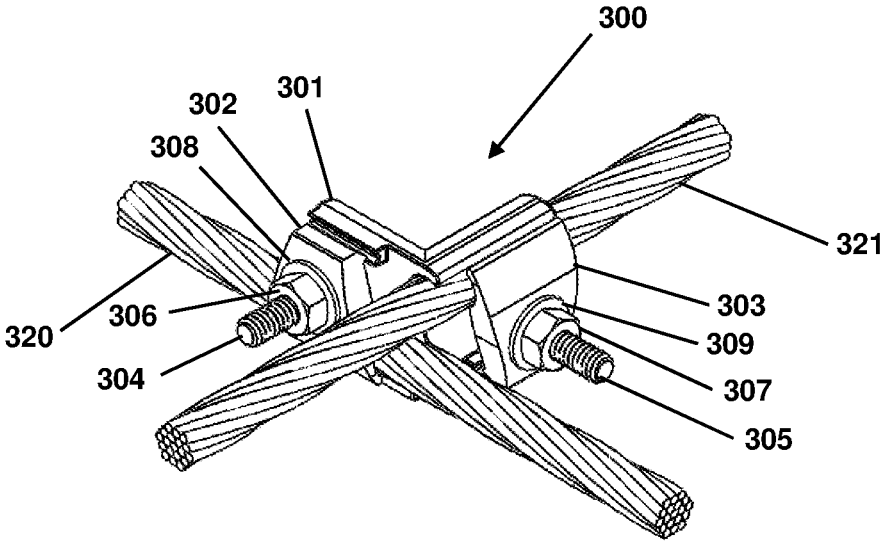
FIG. 23 is another illustration of the grounding cross connector shown in FIG. 20 with conductors installed therein.

Main clamping pad 301 has a set of perpendicular grooves 310 and 311, and each of left and right clamping pads 302 and 303 have a groove 316 which allow conductors 320 and 321 to be securely positioned in grounding cross connector 300. For example, conductor 320 may be placed in groove 310 of main clamping pad 301 and groove 316 of left clamping pad 302, while conductor 321 is placed in groove 311 of main clamping pad 301 and groove 316 of right clamping pad 303, as shown in FIG. 23. Grooves 310, 311, and 316 may be sized to accommodate a wide range of conductor sizes to ensure the conductors are securely held in place by grounding cross connector 300. Grooves 310, 311, and 316 may also have a set of serrations (or raised portions) 315 on their respective surfaces to improve holding power of conductors 320 and 321.

With conductors 320 and 321 placed in their respective grooves, the installer may tighten nuts 306 and 307 to clamp conductors 320 and 321 between main clamping pad 301 and left and right clamping pads 302 and 303. To ensure that all clamping pads are properly aligned, main clamping pad 301 may include channels 312 and 313 in which notch 314 on left and right clamping pads 302 and 303 may rest.

Note that while the present disclosure includes several embodiments, these embodiments are non-limiting, and there are alterations, permutations, and equivalents, which fall within the scope of this invention. Additionally, the described embodiments should not be interpreted as mutually exclusive, and, should instead be understood as potentially combinable if such combinations are permissive. It should also be noted that there are many alternative ways of implementing the embodiments of the present disclosure. It is therefore intended that claims that may follow be interpreted as including all such alterations, permutations, and equivalents as fall within the true spirit and scope of the present disclosure.

The invention claimed is:

1. A grounding cross connector, comprising:

an upper clamping pad comprising:

perpendicular grooves configured to hold a set of grounding conductors;

a first recess shaped to fit a first head included in a first threaded fastener, the first recess configured to prevent movement of the first head when the first head sits in the first recess;

a second recess shaped to fit a second head included in a second threaded fastener, the second recess configured to prevent movement of the second head when the second head sits in the second recess;

a lower clamping pad having perpendicular grooves configured to hold the set of grounding conductors; and wherein the first threaded fastener and the second threaded fastener are configured to compress the upper clamping pad and the lower clamping pad against the set of grounding conductors.

2. The grounding cross connector of claim 1, wherein the upper clamping pad is configured to pivot about the second threaded fastener to engage the first fastener.

3. The grounding cross connector of claim 1, wherein the first recess includes an opening that forms a hook that is configured to receive a shaft of the first threaded fastener.

4. The grounding cross connector of claim 1, wherein the heads of the first and second threaded fasteners are hex-shaped heads.

5. The grounding cross connector of claim 1, wherein the perpendicular grooves of the upper clamping pad intersect and the perpendicular grooves of the lower clamping pad intersect.

6. A method of installing a grounding cross connector, the method comprising:

inserting a first grounding conductor of a set of grounding conductors in one of a pair of perpendicular grooves in a lower clamping pad;

inserting a second grounding conductor in one of a pair of perpendicular grooves in an upper clamping pad;

inserting a first threaded fastener through a first recess of the upper clamping pad, wherein the first recess is shaped to fit a first head included in the first threaded fastener and configured to prevent movement of the first head when the first head sits in the first recess;

inserting a second threaded fastener through a second recess of the upper clamping pad, wherein the second recess is shaped to fit a second head included in the second threaded fastener and configured to prevent movement of the second head when the second head sits in the second recess; and tightening the first and second threaded fasteners to compress the upper clamping pad and the lower clamping pad against the set of grounding conductors.

7. The method of claim 6, further comprising pivoting the upper clamping pad about the second threaded fastener from an open position to a closed position; and engaging the first fastener with a hook of the upper clamping pad.

8. The method of claim 6, wherein the heads of the first and second threaded fasteners are hex-shaped heads.

9. The method of claim 6, wherein the perpendicular grooves of the upper clamping pad intersect and the perpendicular grooves of the lower clamping pad intersect.

* * * * *